US006971614B2

(12) United States Patent
Fischer et al.

(10) Patent No.: US 6,971,614 B2
(45) Date of Patent: Dec. 6, 2005

(54) SLATWALL HANGER STABILIZING CHIP

(75) Inventors: James R. Fischer, Sheboygan, WI (US); Greg R. Fischer, Howards Grove, WI (US)

(73) Assignee: Jifram Extrusions, Inc., Sheboygan Falls, WI (US)

( * ) Notice: Subject to any disclaimer, the term of this patent is extended or adjusted under 35 U.S.C. 154(b) by 4 days.

(21) Appl. No.: 10/617,914

(22) Filed: Jul. 11, 2003

(65) Prior Publication Data

US 2005/0006539 A1 Jan. 13, 2005

(51) Int. Cl.[7] ..... E04G 5/06
(52) U.S. Cl. ..... 248/220.43; 211/94.01; 248/222.51
(58) Field of Search ..... 248/220.42, 220.43, 248/222.51, 220.22, 221.11; 52/36.5, 489.1, 52/712; 211/94.01

(56) References Cited

U.S. PATENT DOCUMENTS 3,813,070 A * 5/1974 Hanson ..... 248/220.43
4,303,217 A * 12/1981 Garfinkle ..... 248/220.42
4,615,448 A * 10/1986 Johnstonbaugh ..... 211/94.01
6,418,671 B1 * 7/2002 DeRuiter et al. ..... 52/36.4
6,631,813 B1 * 10/2003 Walter et al. ..... 211/94.01
2003/0189019 A1 * 10/2003 Campbell et al. ..... 211/94.01

* cited by examiner

*Primary Examiner*—Ramon O Ramirez
(74) *Attorney, Agent, or Firm*—Andrus, Sceales, Starke & Sawall, LLP

(57) ABSTRACT

The present invention pertains to a removable clip that stabilizes a hanger mounted on a slatwall assembly formed by a number of horizontally aligned and uniformly spaced slats or boards. The upper and lower end of each slat has a lip with an inside surface, so that adjacent slats form a slot with a narrow outer portion and a wider inner portion. The hanger has an upper end that is inserted into an upper slot, and a lower end that hangs down near a lower adjacent slot. The stabilizing clip has a main body and an extending brace. The body is shaped to firmly snap fit into the lower slot. The brace extends upwardly along a middle slat to form a slot for receiving the lower end of the hanger and retaining it against the surface of the middle slat. In a second embodiment, the clip also includes a riser for supporting the lower end of the hanger and positioning the hanger so that its upper end more fully engages the inside surface of the lip of an upper slat.

16 Claims, 6 Drawing Sheets

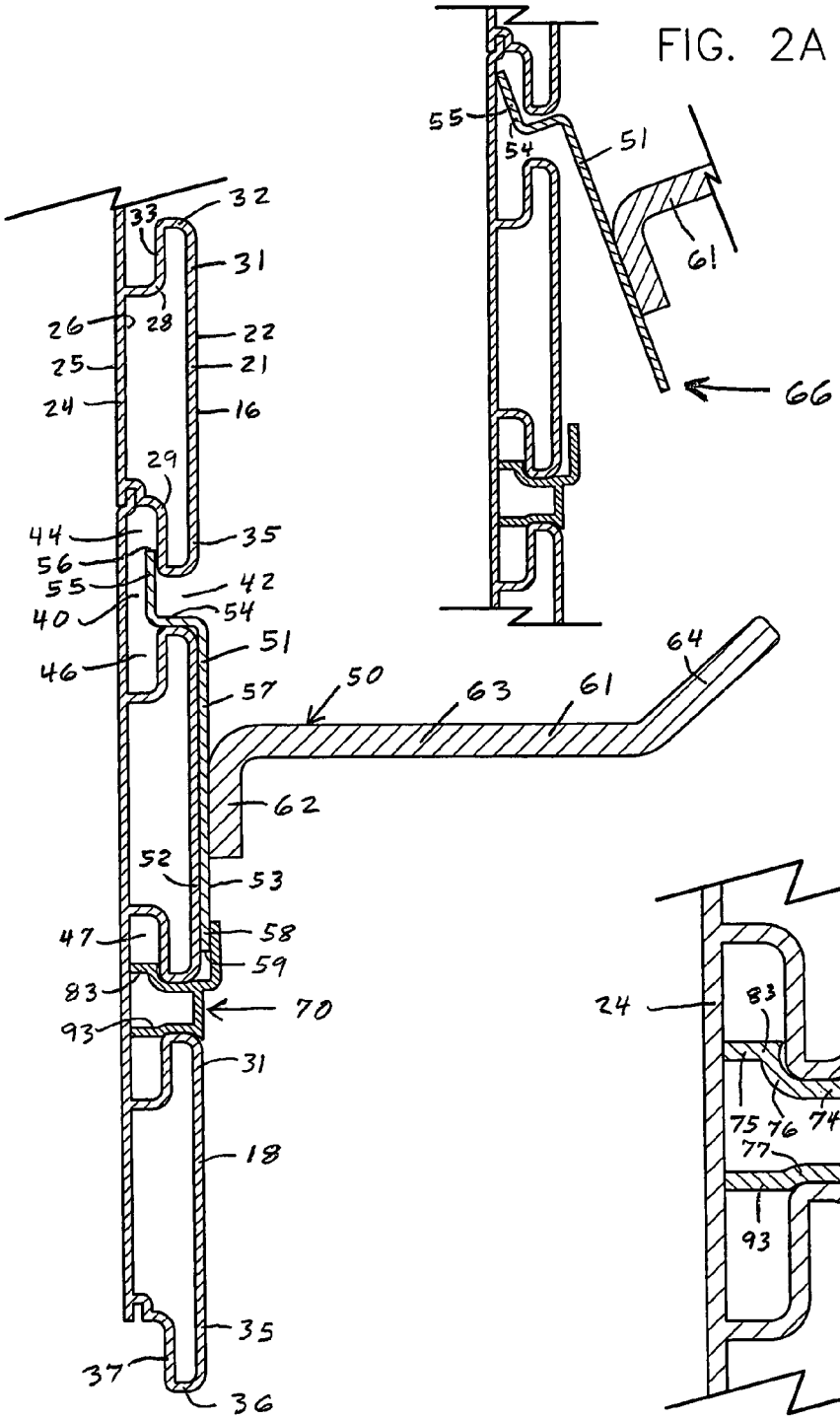
FIG. 2
FIG. 2A
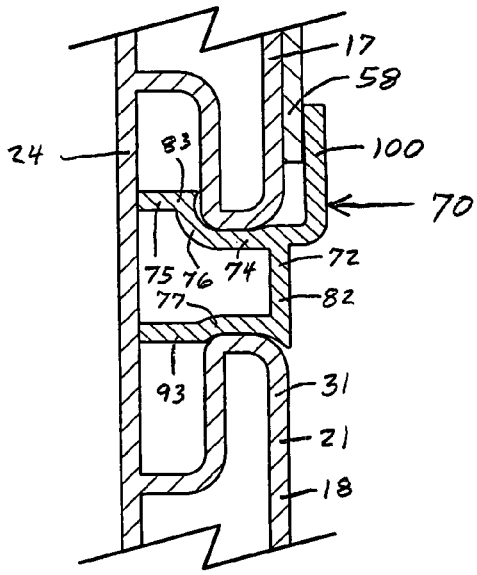
FIG. 3

SLATWALL HANGER STABILIZING CHIP

TECHNICAL FIELD OF THEE INVENTION

The present invention relates to a stabilizing clip for a hanger of a slatwall assembly.

BACKGROUND OF THE INVENTION

Slatwall is used to support or display a wide variety of products in an organized manner. The slatwall is typically mounted flush against a wall, and is particularly useful in retail stores, garages and the like where goods or items need to be displayed or stored, and a more finished look is desired but bulky cabinets or conventional shelving are inappropriate due to lack of space. Slatwall includes a number of horizontal boards or slats. Adjacent slats are spaced apart a given distance to form a number of uniform, horizontal slots. The slots are evenly spaced, one above the other, through the height of the slatwall. A number of hangers or supporting hardware are secured to the slatwall by inserting them into the slots. The hanger are generally cantilevered from the slatwall so that items can be hung from or supported by the hangers. The hangers or hardware can also be used to support a platform for displaying or storing smaller items such as shoes, packaged fasteners or the like.

A problem with conventional slatwall is that the supporting hardware can be dislodged. When people walk by slatwall or quickly reach for an item on the slatwall, they can inadvertently bump one or more of the hangers with enough force to rotate and dislodge the hanger and cause it and the item it is supporting to fall to the ground. This can be particularly frustrating and embarrassing to customers and storekeepers in a retail store setting, and can damage the goods being displayed. When the slatwall is supporting heavy or sharp objects such as shovels, racks, saws, and the like as in a garage setting, the falling objects can cause injury. When many items are hung or supported by the slatwall at different heights and a person bumps one of the upper hangers, a cascading effect can result with several pieces of hardware and objects falling to the ground.

Another problem with conventional slatwall hangers is the unreliable nature with which they grip the slatwall. Only a small portion of the hanger typically engages the slatwall to keep it from falling to the ground. Frequently, only one eighth (⅛) inch of the rim of the hanger engages the slatwall to prevent the hanger from rotating forward and falling to the ground. This small contact area produces concentrated stresses on the hanger and slatwall. These stresses can bend the rim of the metal or plastic hanger and cause the hanger to rotate forward or otherwise pop out of its supporting slot and fall to the ground. Similarly, these concentrated stresses can bend, chip or break the slatwall and cause the hanger to rotate forward and out of its slot. Normal wear and tear on the slatwall and the hangers can cause the assembly to function unreliably because the hangers are more easily dislodged and knocked from place during use. Hangers with slightly bent or worn rims will no longer grip the portions of some or all of the slots, particularly if the lip is worn or chipped. Wood slatwall is particularly problematic because the edges of the lips of the board forming the slot can chip under stress or through normal wear and tear, which permanently damages the slatwall so that hangers will continue to pop out at the damaged location. Slight variations in the uniformity of the slots due to manufacturing tolerances and installation error also cause the hangers to grip the slatwall less reliably in certain areas of the assembly.

A further problem with conventional slatwall is that it can be difficult to rearrange the hangers and the items being displayed or stored on the slatwall. More permanent type fasteners such as nails or screws that secure the hangers to the slatwall need to be removed. This is a cumbersome process that damages the slatwall. Adding or removing even one hanger and item to the slatwall can require the removal and reattachment of several hangers. Repeated rearrangements of the hangers ultimately causes physical and aesthetic damage to the slatwall. Replacing or repairing the slatwall results in extra expenses and down time.

The present invention is intended to solve these and other problems.

BRIEF DESCRIPTION OF THE INVENTION

The present invention pertains to a removable clip that stabilizes a hanger mounted on a slatwall assembly formed by a number of horizontally aligned and uniformly spaced slats or boards. The upper and lower end of each slat has a lip with an inside surface, so that adjacent slats form a slot with a narrow outer portion and a wider inner portion. The hanger has an upper end that is inserted into an upper slot, and a lower end that hangs down near a lower adjacent slot. The stabilizing clip has a main body and an extending brace. The body is shaped to firmly snap fit into the lower slot. The brace extends upwardly along a middle slat to form a slot for receiving the lower end of the hanger and retaining it against the surface of the middle slat. In a second embodiment, the clip also includes a riser for supporting the lower end of the hanger and positioning the hanger so that its upper end more fully engages the inside surface of the lip of an upper slat.

One advantage of the present slatwall clip invention is that it more reliably secures or stabilizes the lower end of the hanger to the slatwall. The clip helps prevent backward rotation of the hanger so that it cannot be easily dislodged. The hangers remain in their set position when inadvertent bumped by a person walking by the slatwall display assembly or a person reaching to grab an item hanging or otherwise supported by the slatwall. The clips significantly improve the overall performance and satisfaction of the slatwall assembly. Displayed and stored goods are kept in place and are less likely to be damaged. Customers and storekeepers do not need to keep picking up slatwall hardware and display items, and heavy or sharp items are less likely to fall and injure people.

Another advantage of the present slatwall stabilizing clip is that it increases the contact area between the hanger and the slatwall to improve the strength and reliability of the slatwall assembly. The stabilizing clip has a riser that lifts the hanger up into the upper slot and increases the contact area between the upper end of the hanger and the upper slatwall. A full half (½) inch of the hanger engages the inside surface of the lip of the upper slatwall. This increase in contact area reduces the stresses on the hanger and slatwall. As a result, much heavier objects can be more reliably hung from the hangers without risk that the hanger will pop out during use, even if inadvertently bumped. The upper rims of the hangers and the lips of the slatwall are not likely to bend to allow the hanger to pop out of its supporting slot during use.

Further advantage of the present slatwall clip is that it allows easy rearrangement of the slatwall hangers. The clips and hangers can be easily removed and secured at different locations on the slatwall assembly. The clip is snap-fit into place without the need of any tools, and can be easily removed with a screwdriver or other similar flat headed tool.

No nails or screws are required to secure the hardware to the slatwall, so the slatwall remains physically sound and aesthetically pleasing even after many rearrangements of the display items.

Other aspects and advantages of the invention will become apparent upon making reference to the specification, claims and drawings.

BRIEF DESCRIPTION OF THE DRAWINGS

FIG. 2 is a side sectional view showing one of the retaining clips fastened in a slot between two adjacent slatwall boards to secure a hanger to the slatwall.

FIG. 3 is an enlarged side sectional view of FIG. 2 showing the retaining clip securing its respective hanger to the slatwall.

DESCRIPTION OF THE PREFERRED EMBODIMENTS

While this invention is susceptible of embodiments in many different forms, the drawings show and the specification describes in detail the preferred embodiments of the invention. It should be understood that the drawings and specification are to be considered an exemplification of the principles of the invention. They are not intended to limit the broad aspects of the invention to the embodiments illustrated.

Figure 1:
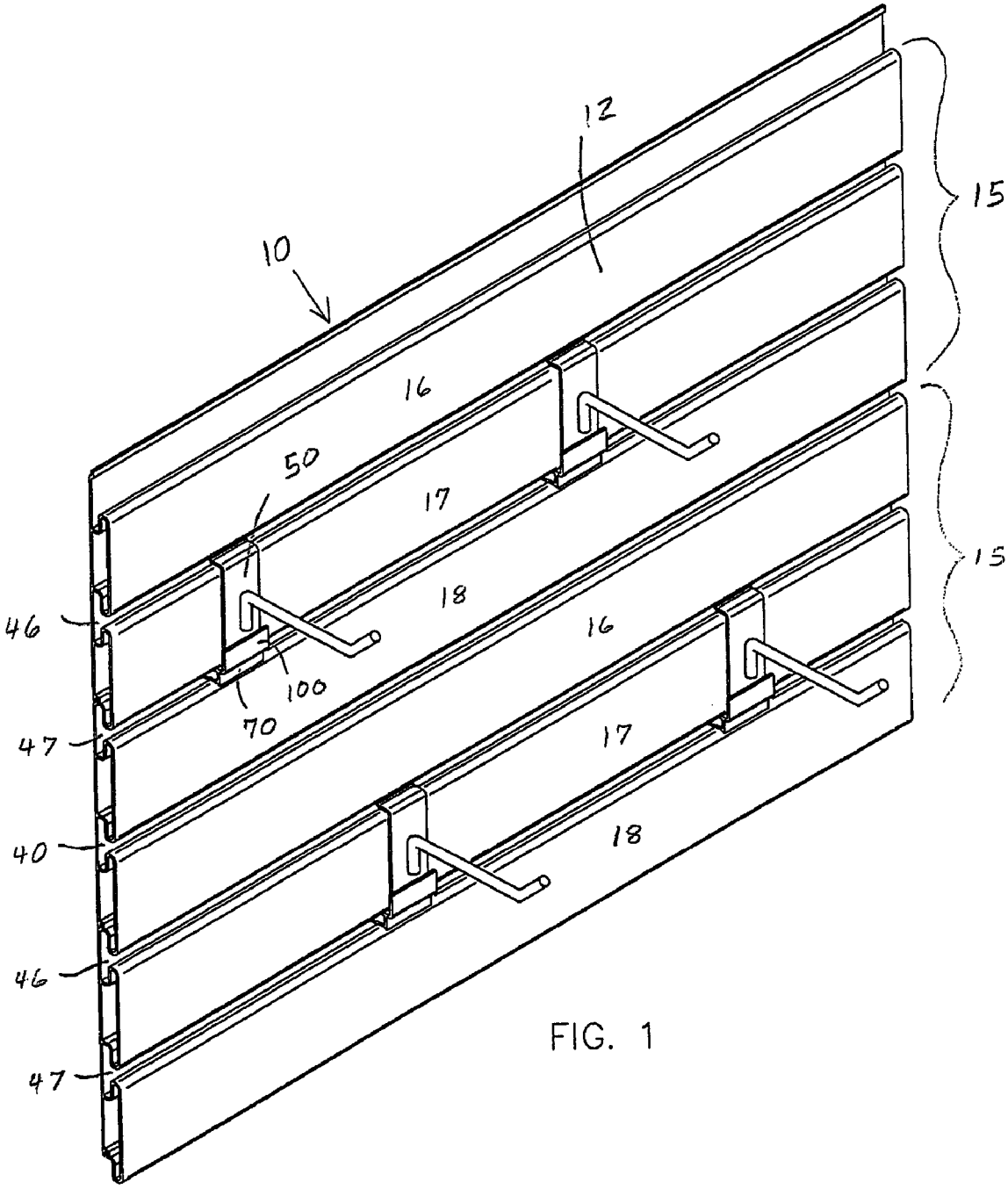
FIG. 1 is a perspective view of a slatwall assembly formed by several horizontal sections of slatwall with hooks that are secured in place by the present retaining clip invention.
Figure 4:
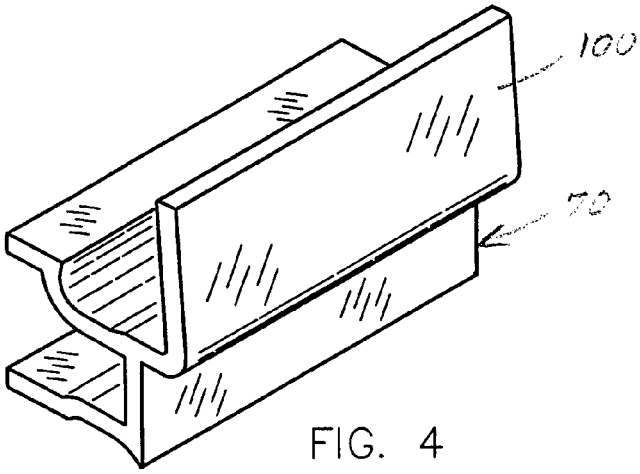
FIG. 4 is a perspective view of the retaining clip.
Figure 5:
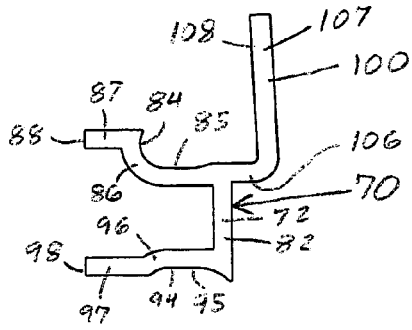
FIG. 5 is a side view of the retaining clip.
Figure 6:
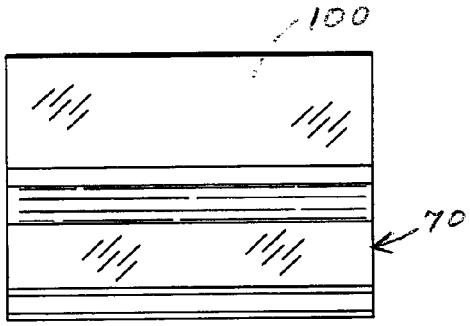
FIG. 6 is a rear view of the retaining clip.
Figure 7:
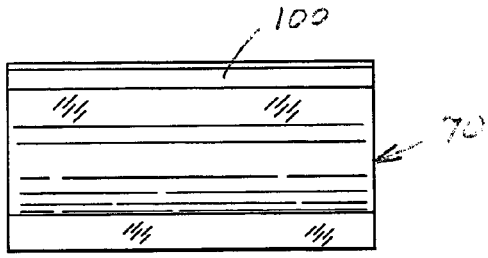
FIG. 7 is a top view of the retaining clip.
Figure 8:
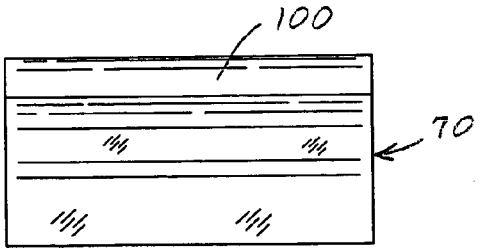
FIG. 8 is a bottom view of the retaining clip.
Figure 9:
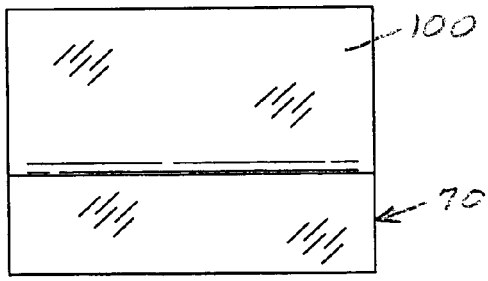
FIG. 9 is a front view of the retaining clip.
Figure 10:
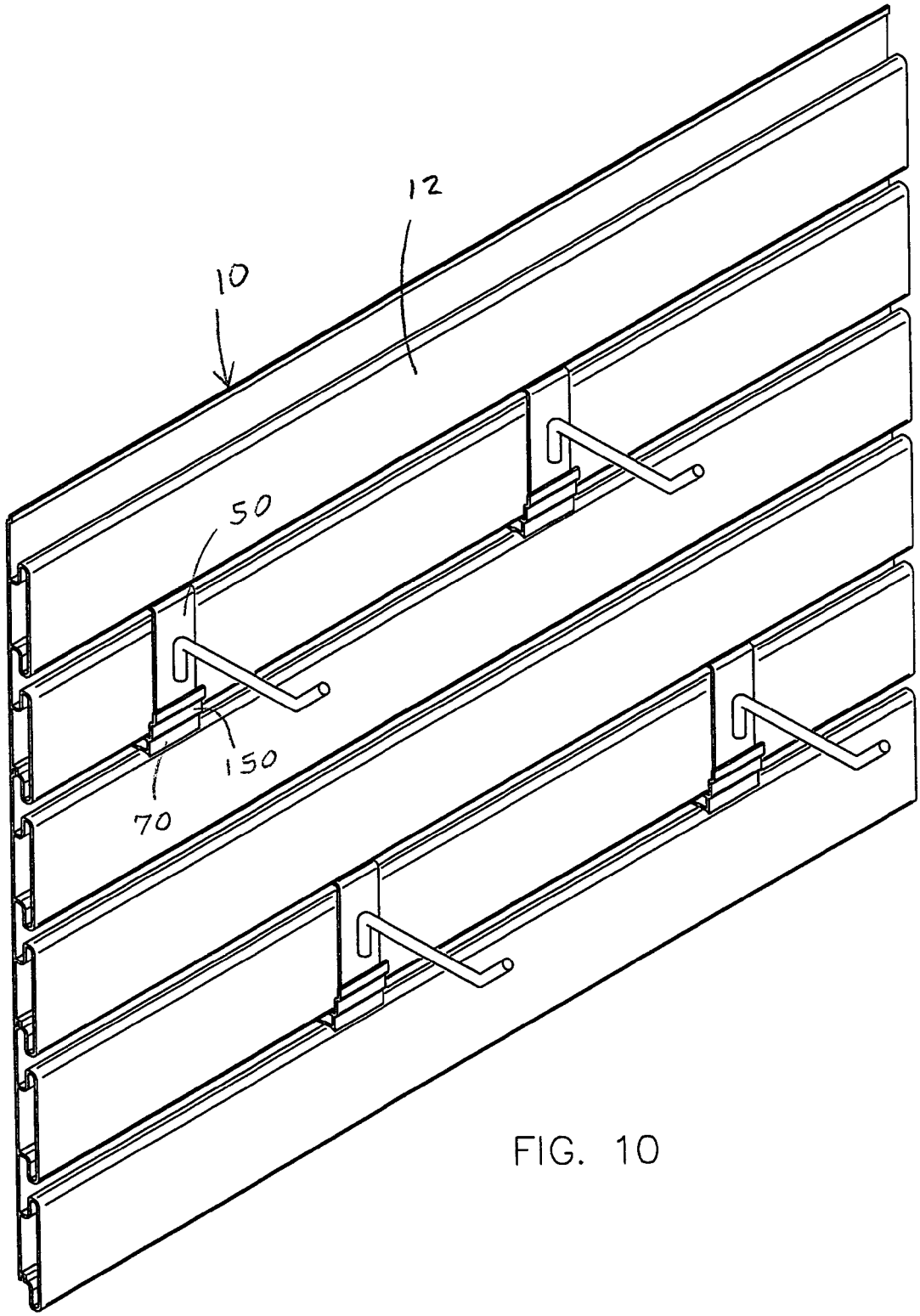
FIG. 10 is a perspective view of a slatwall assembly formed by several horizontal sections of slatwall with hooks that are secured in place by a second embodiment of the present retaining clip invention.
Figure 11:
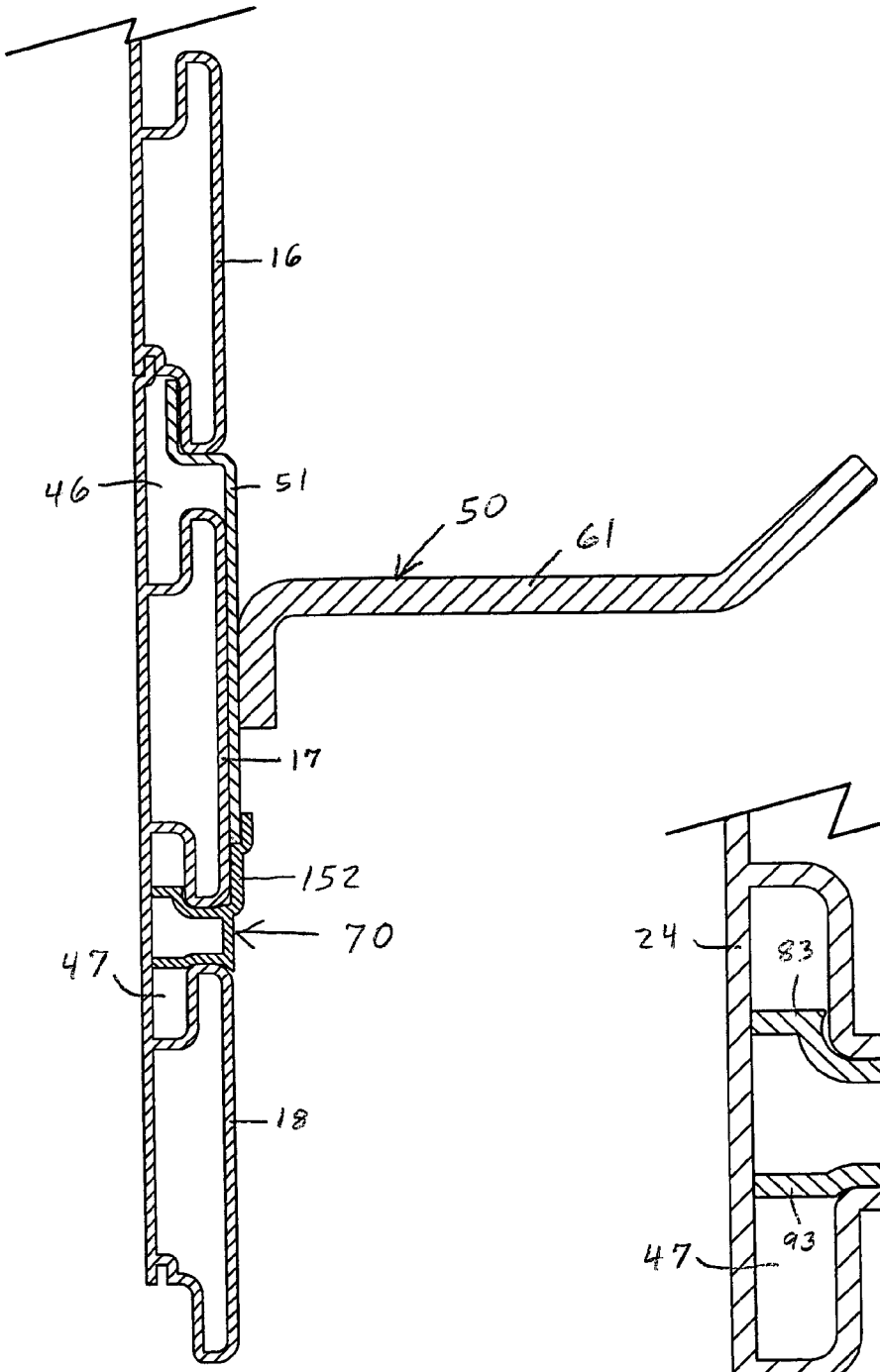
FIG. 11 is a side sectional view showing the second embodiment of the retaining clip fastened in a slot between two adjacent slatwall boards to secure a hanger to the slatwall.
Figure 12:
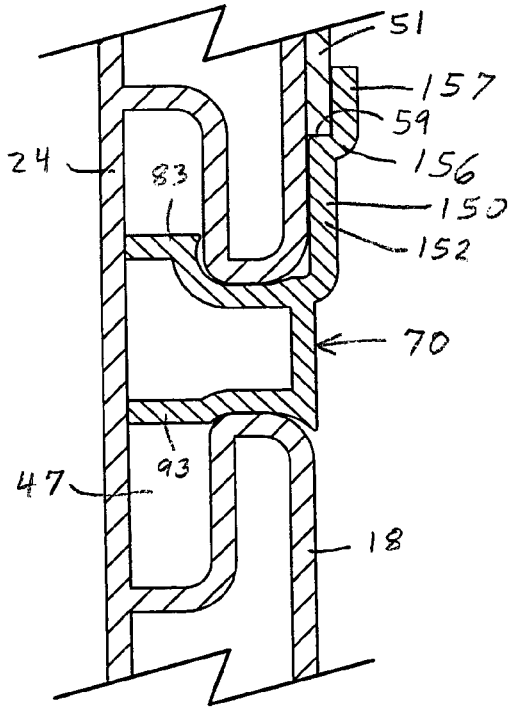
FIG. 12 is an enlarged side sectional view of FIG. 11 showing the retaining clip securing its respective hanger to the slatwall.
Figure 13:
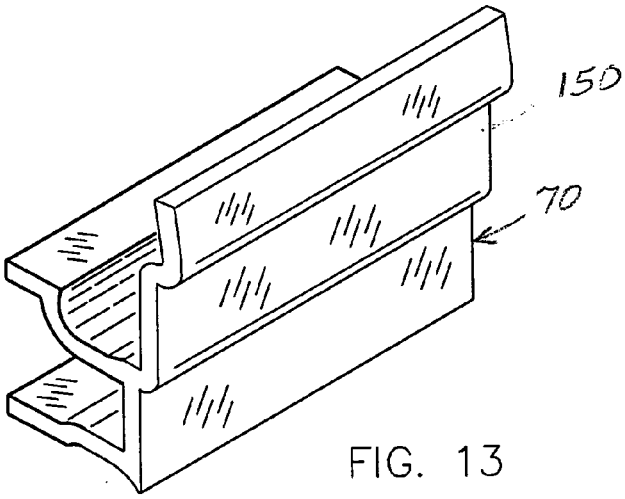
FIG. 13 is a perspective view of the second embodiment of the retaining clip.
Figure 14:
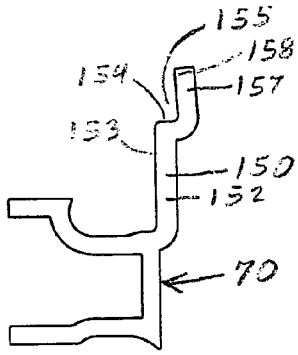
FIG. 14 is a side view of the second embodiment of the retaining clip.
Figure 15:
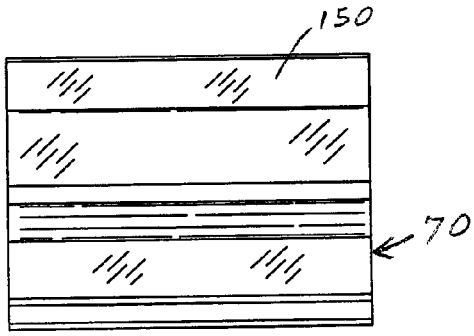
FIG. 15 is a rear view of the second embodiment of the retaining clip.
Figure 16:
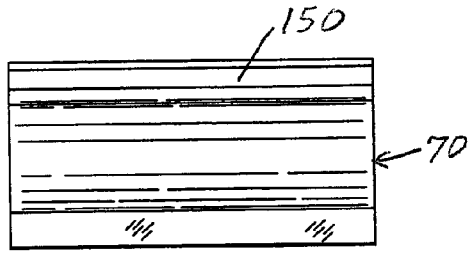
FIG. 16 is a top view of the second embodiment of the retaining clip.
Figure 17:
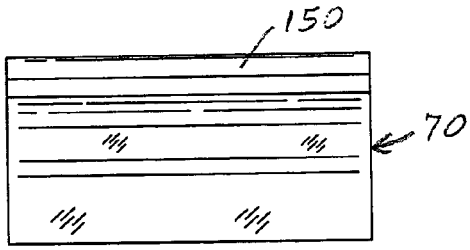
FIG. 17 is a bottom view of the second embodiment of the retaining clip.
Figure 18:
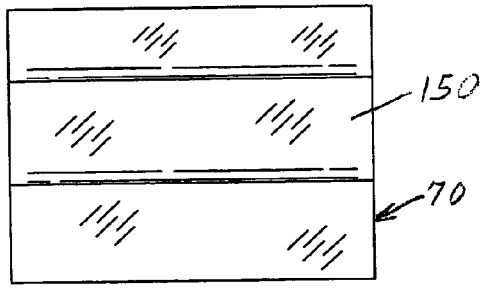
FIG. 18 is a front view of the second embodiment of the retaining clip.

The walls of a building in residential, commercial and industrial buildings are frequently equipped with a slatwall assembly 10 as shown in FIG. 1. The slatwall assembly 10 is used to mount or display a variety of objects off the floor of the building in an organized manner. The objects can be similar, such as in a display for a number of shoes, or they can vary in size, shape, weight and type, such as in a garage to mount shovels, racks, saws, gardening tools, etc. The slatwall assembly 10 includes a number of like-shaped slats or boards 12 that are horizontally aligned and uniformly spaced from their adjacent boards. Each board 12 can be a separate piece that is individually secured to the wall, or two or more boards can take the form of an integral piece as shown in FIG. 2. The slatwall assembly 10 and boards 12 are preferably made of plastic and formed by an extrusion or molding process, but can be made of wood, fiber board or other suitable materials having a desired combination of rigidity, strength, durability and aesthetic appearance. In the present invention, three adjacent boards 12 form a working set 15 that includes an upper board 16, a middle board 17 and a lower board 18.

Each board 12 has a front wall 21 with a front surface 22, and a rear wall 24 with front and rear surfaces 25 and 26. The front wall 21 and surface 22 typically have a width of three (3) inches. The rear surfaces 25 of the boards 12 lay flush against the wall. The rear wall 24 has a middle portion that integrally joins two adjacent slats 12 to form a single piece, and an upper portion for positioning and engaging a separate adjacent piece. Each board 12 has opposed top and bottom side walls 28 and 29. The cross-sectional shape of the side walls 28 and 29 of each board 12 are similarly shaped mirror images. The top side 28 forms an upwardly extending upper lip 31 with a substantially horizontal outer end or end surface 32 and a substantially vertical inner surface 33. The bottom side 29 has a downwardly extending lower lip 35 with a substantially horizontal outer end or end surface 36 and a substantially vertical inner surface 37. The inside surfaces 33 and 37 typically have a width dimension of about one-quarter to one-half (¼ to ½) inch.

Each set of two adjacent boards 12 forms a uniform slot 40. Each slot 40 has substantially the same T-shaped cross-sectional shape, and extends the length of the slatwall assembly 10 from one side to the other. The like-shaped slots 40 have a narrow portion 42 that forms an opening into the slot. The narrow portion 42 is located between the lips 30, and more particularly between the planes formed by front surface 22 of the front wall 21 and the inside surface 37 of the lips 30. The narrow portion 42 has a width dimension between the lips 30 of about three-eighths (⅜) of an inch, and a depth dimension into the slatwall 10 of about one-quarter (¼) inch. The wider portion 44 is located between the inside surface 37 of the lips 30 and the rear wall 24. The wider portion 44 has a width dimension of about one and three-eighths (1⅜) inch, and a depth dimension of about one-quarter (¼) inch. The total depth of the slot 40 is generally one half (½) inch. The upper board 16 of each working set 15 combines with the middle board 17 to form an upper slot 46. The lower board 18 combines with the middle board 17 to form a lower slot 47. Although the slats 12 are shown and described to have upper and lower lips 31 and 35 and form T-shaped slots 40, it should be understood that the top sidewall 28 of the slats could be flat or without the upper lip to form L-shaped slots without departing from the broad aspects of the invention.

Hangers 50 are removably mounted or otherwise secured to the slatwall assembly 10. As shown in FIGS. 1 and 2, each hanger 50 has a bracket 51 for mounting the hanger to the slatwall 10, and a hang rod 61 for supporting goods. The securement bracket 51 has inside and outside surfaces 52 and 53, an upper portion 54 with a step 55 and an uppermost end 56, a middle portion 57 that is generally flat, and a lower portion 58 with a lowermost end 59. The stepped portion 54 has a length dimension of slightly less than the length of the lips 30 or slightly less than about one-half (½) inch. The combined length dimension of the middle and lower portions 57 and 58 is slightly less than the length of the board or just less than about three (3) inches. The hang rod 61 has one end 62 that is secured to the middle portion 57 of the bracket 51, a cantilevered middle portion 63 that extends generally horizontally when the hanger is mounted to the slatwall 10, and an inclined end 64 that angles up to keep the goods from sliding off the hanger 50. The weight of the goods is generally supported by the cantilevered portion 63 of the hanger 50. This cantilever support 50 creates a torque that causes the middle and lower portions 57 and 58 of the bracket 51 to push against the front wall 21 of the middle board 17, and the upper most end 56 of the stepped portion 54 to push against the lip 35 of the upper board 16. The structure of the cantilevered hanger 50 uses the weight of the goods to hold or otherwise secure the hanger in place. As best shown in FIG. 2, the lips 30 and slots 40 of the slatwall 10 combine with the stepped portion 54 of the hanger 50 to prevent it from rotating forward out of the slot 40 and off of its supporting engagement with the slatwall. Although the hanger 50 is shown and described to have a particular shape, it should be understood that other hangers or pieces of hardware with other shapes could be used to support the goods or a rack or tray for the goods without departing from the broad aspects of the invention.

To secure the hanger 50 to the slatwall 10, the upper stepped portion 54 is angled backward to a tilted position 66 and inserted into upper slot 46. Once the uppermost portion 56 clears the narrow portion 42 and enters the wider portion 44 of the upper slot 46, the hanger 50 is rotated by hand, gravity or otherwise into a generally vertical or set position 67 as shown in FIGS. 1 and 2. In this set or installed position 67, the weight of the goods and hanger 50 are supported by the step 55, which is resting on or otherwise supported by the upper lip 31 of the middle board 17. As noted above, the outside surface 52 of the uppermost end 56 engages the inside surface 37 of the lower lip 35 of the upper board 16. The inside surface 52 of the generally flat middle and lower portions 57 and 58 of the hanger bracket 51 are flush with and pushing against the front surface 22 of the front wall 21 of the middle board 17. When an item is hung on or supported by the hanger rod 61, the weight of the item is transferred through the hanger 50 to the upper lip 31 of the middle board 17. Although the hanger 50 is secured to the slatwall 10 when in its set position 67, should the item or hanger be inadvertently bumped, the hanger 50 can rotate backward in the slot 40 to its tilted or release position 66, slide out of the wider portion 44 of the upper slot 46, and fall to the floor along with the item it is supporting.

A stabilizing clip 70 retains the hanger 50 in its set position 67 and prevents it from rotating backward into its tilted or release position 66 as shown in FIGS. 1–3. The stabilizing clip 70 has a main body 72 that is removably secured to the lower slot 47, and a brace 100 that engages the lower portion 58 of the hanger 50 to prevent it from rotating out of its set position. The clip 70 is preferably made of an extruded plastic such as clear, rigid PVC, but could be made of other suitable materials, such as sheet metal, hardened rubber, or other plastics that are generally strong enough to retain their shape under force during their use, but allow a slight degree of flexibility to facilitate the insertion and removal of the clip from one of the slots 40. Although the clip 70 is preferably a single integral piece, it should be understood that it could include two or more separate components without departing from the broad aspects of the invention.

The main body 72 of the clip 70 has a narrow portion 74 and an offset or wider portion 75. The narrow portion 74 has a width dimension substantially equal to the width dimension of the narrow portion 42 of the slots 40. The offset portion 75 has at least one offset 76, and preferably two opposed offsets 76 and 77, that combine with the width of the narrow portion 74 to form a width dimension larger than that of the narrow portion 42, but smaller than the width dimension of the wider portion 44 of the slot 40. The clip 70 is slightly resilient or otherwise movable to allow the wider portion 75 to selectively flex or bend to a contracted position during its insertion and removal through the narrower portion 42 of the slot 40, and return to its enlarged or offset shape once inserted into the wider portion 75 or removed from the slot 40.

The main body 72 preferably includes a middle section or torso 82, and two opposed extensions 83 and 93. The middle section 82 is formed by a relatively thin wall that is substantially planarly aligned with the front wall 21 of the slats 12. The front surface of the middle section 82 is generally flush with the front surface 22 of the front wall 21. The upper extension or arm 83 is integrally joined to an upper end of the middle section 82, and extends rearwardly toward the rear wall 24 of the slatwall 10. The arm 83 includes an outer surface 84, a first spacing segment 85, an offset 86, a second spacing segment 87 and an end 88. The lower extension or leg 93 is integrally joined to a lower end of the middle section 82, and extends rearwardly toward the rear wall 24 of the slatwall 10. The leg 93 includes an outer surface 94, a first spacing segment 95, an offset 96, a second spacing segment 97 and an end 98. The outer surfaces 84 and 94 of the first spacing segments 85 and 95 and offsets 86 and 96 form an arcuate shape and surface to more flushly engage the surfaces of the upper and lower lips 31 and 35, respectively, when the clip 70 is inserted into one of the slots 40. The second spacing segments 87 and 97 have a length so that their ends 88 and 98 engage the rear wall 24 of the slatwall 10. When the clip 70 is inserted into a slot 40, the ends 88 and 98 of the upper and lower extensions 83 and 93 are elastically flexed toward each other so that they will fit through the narrow portion 42 of the slot. Once the large offset 86 of the arm 83 clears the inner surface 33 of its corresponding lip 31, the arm is biased to return to its normal position shown in FIG. 3 so that its outer surface 84 engages the inside surface of that lip. Similarly, once the smaller offset 96 of the leg 93 clears the inner surface 37 of its corresponding lip 35, the leg is biased to return to its normal position so that its outer surface 94 begins to engage the inside surface of that lip.

The brace 100 of the stabilizing clip 70 retains the hanger in its set position 67 during use so that the hanger is not inadvertently bumped out of engagement with its slot 40 in the slatwall 10.

The brace 100 has a horizontal neck 106, a substantially vertical head 107, and an inside surface 108 as best shown in FIGS. 1–9. The head 107 is extruded to have a slight backward angle or pitch when in its relaxed state, so that the head tends to press against the hanger 50 when it is secured in one of the slots 40. Although the horizontal distance between the surface 84 of the offset 86 and the surface 108 of the head proximal the neck 106 is equal to or slightly greater than the width of the upper lip 31, the backward angle of the head 107 creates a snug fit between the clip 70 and the upper lip. The backward angle of the head 107 also tends to push the end 98 of the lower extension or leg 93 into abutting engagement with the rear wall 24 of the slatwall 10 so that the front surface of the middle section 82 of the clip is substantially flush with the front surface 22 of the slats 12. The head 107 of the brace 100 and the offset 86 of the upper arm 83 help keep the lower portion 58 of the hanger 50 against or near the front wall 21 of the slatwall 10 so that the hanger cannot be easily rotated to its release position. The abutting engagement of the end 98 of the leg 93 against the rear wall 24 of the slatwall 10 also helps keeps the brace 100 and clip 70 from rotating and the hanger 50 against or near the front wall 21.

FIGS. 10–18 show a second embodiment of the stabilizing clip 70 with the same main body 72 and a modified brace 150. The brace 150 includes a riser 152 with an inside surface 153 and an upper end 154. The riser 152 has a length dimension that is slightly shorter than that of the inside surface 33 of the lips 31 or 35. The length of the riser 152 positions or otherwise raises the hanger 50 relative to the slatwall 10 so that the outer surface 53 of the vertical segment of the upper stepped portion 54 of the hanger more fully engages the inside surface 33 of the lip 31 of the upper slat 16. Preferably, a majority of the outer surface 53 of the vertical segment of the upper stepped portion 54 abuttingly engages the inside surface 33 of the lip 31 of the upper slat 16. The riser 152 is angled back in the same manner as the head 107 of brace 100, so that its inside surface 153 presses against the front wall 21 of the middle slat 17. The upper end 154 forms a shoulder for supportably engaging the end 59 of the hanger 50. Similar to the other embodiment, the brace 150 has a horizontal neck 156, a substantially vertical head 157, and an inside surface 158. The neck 156 is shorter in length and combines with the shoulder 154 to form a slot 155 for receiving the lower portion 58 of the hanger 50. The head 157 is also angled back so that it presses the lower portion 58 of the hanger 50 against the middle slat 17. The weight load carried by the hanger 50 is transferred via the riser 152 and its shoulder 154 to the lower lip 35 of the lower slat 18. One way to remove the clip 70 from the slot 40 of the slatwall 10 is to slide the hanger 50 or clip 70 along the slot so that the brace 100 or 150 of the clip no longer engages the hanger. The flat head of a regular screw driver can then be inserted between the brace 100 or 150 and the front wall 21 of the slat 12 and rotated to pry or otherwise work the clip 70 out of the slot 40.

While the invention has been described with reference to its preferred embodiments, it will be understood by those skilled in the art that various changes may be made and equivalents may be substituted without departing from the broad aspects of the invention.

We claim:

1. A stabilizing clip for securing a hanger to a slatwall assembly, the hanger having upper and lower end portions, and the slatwall assembly having a plurality of spaced apart slats including upper, lower and middle slats, the upper and middle slats forming a uniform upper slot, and the lower and middle slats forming a uniform lower slot, the slats having front and rear walls and surfaces and upper and lower lips, each lip having an inside surface spaced between the front and rear surfaces of its slat, the upper and lower slots having a narrow portion with a predetermined width dimension proximal the front wall of the slats and a wider portion with a larger width dimension between the lips and rear wall of the slats, the hanger being secured to the upper slot, and said stabilizing clip comprising:

a body having resilient lower and upper portions that define narrow and offset portions, said narrow portion having a width dimension adapted to be substantially equal to the width dimension of the narrow portion of the lower slot, and said offset portion having an offset that combines with said narrow portion to form a width dimension adapted to be larger than the width dimension of the narrow portion of the lower slot, said resilient lower and upper portions being adapted to permit said offset portion to flex and fit through the narrow portion and into the wider portion of the lower slot, said resilient lower portion having a lower leg being adapted to biasingly engage the upper lip of the lower slat and said resilient upper portion having an upper arm being adapted to biasingly engage the lower lip of the middle slat when said body is inserted into the lower slot, said offset portion having a forwardly facing surface adapted to engage the inside surface of one of either the upper and lower lips when said body is inserted into the lower slot, said arm and leg adapted to extend toward and engage the rear wall at spaced locations, said engagement of said body with the slats firmly securing said body to and between the slats; and, a brace extending upwardly from said body, said brace having an inner surface adapted to be spaced from the front surface of the middle slat to form a slot to receive the lower end portion of the hanger and hold the hanger against the middle slat to maintain the hanger in a set position.

2. The stabilizing clip of claim 1, and wherein said resilient lower portion is spaced from said resilient upper portion, and said resilient lower portion forms said lower leg and said resilient upper portion forms said upper arm.

3. The stabilizing clip of claim 2, and wherein said offset portion is a wider portion having a width dimension adapted to be larger than the width dimension of the narrow portion of the lower slot.

4. The stabilizing clip of claim 3, and wherein said wider portion of said body is adapted to be snap fit through the narrow portion of the lower slot and into the wider portion of the lower slot.

5. The stabilizing clip of claim 2, and wherein said upper arm includes a spacer having opposed ends and a predetermined length, said opposed ends being adapted to be snugly received between said lip of said middle slat and said rear wall of said slatwall assembly.

6. The stabilizing clip of claim 1, and wherein said lower leg and upper arm have a predetermined length and said body has a front surface, and said front surface of said body is adapted to be substantially flushly aligned with the front surfaces of the slats when said leg and arm abut the rear wall of the slatwall assembly.

7. The stabilizing clip of claim 1, and wherein said firm securement of said clip in the lower slot prevents the hanger from rotating to a release position.

8. The stabilizing clip of claim 1, and wherein said inside surface of said brace is adapted to be biased to a substantially parallel position with and presses the hanger against the front surface of the middle slat when said body is inserted into the lower slot.

9. The stabilizing clip of claim 1, and wherein said brace includes a riser and a shoulder, said shoulder forming a platform for supportably engaging the end of the lower portion of the hanger, said riser positioning said hanger and its stepped portion to more completely engage the inside surface of the lip of the upper slat.

10. The stabilizing clip of claim 9, and wherein the hanger exerts a load on said shoulder of said brace, said body has a front wall, and said riser and said front wall are integrally joined and substantially planarly aligned and adapted to the downward load to the upper lip of the lower slat.

11. A stabilizing clip for securing a hanger to a slatwall assembly, the hanger having a bracket with first and second end portions for supporting the weight of an object, and the slatwall assembly having a plurality of spaced apart slats including first, second and third slats, the first and second slats forming a first slot, and the second and third slats forming a second slot, each slat having a surface and said first slat having a lower lip with an inside surface, the first end portion of the hanger being received by the first slot and the second end portion of the hanger positioned proximal the second slot, said stabilizing clip comprising:

a body shaped to securely fit into the second slot;

a riser extending from said body, said riser having a shoulder for supportably engaging the second end portion of the hanger, said riser positioning said hanger with its first end portion adapted to more fully engage the inside surface of the lip of the first slat; and, a brace extending upwardly from said body and having an inner surface that combines with said shoulder to form a third slot for receiving the lower end portion of the hanger and retain the hanger proximal the second slat.

12. The stabilizing clip of claim 11, and wherein said body has a front wall and the weight of the object is transferred from the hanger to said shoulder of said riser, and said riser and said front wall of said body are integrally joined and substantially planarly aligned and adapted to transfer the weight to the upper lip of the lower slat.

13. The stabilizing clip of claim 11, and wherein each slat has front and rear surfaces and first and second opposed lips, and each lip has an inside surface adapted to be spaced between the front and rear surfaces of its slat, each of said first and second slots having a narrow portion with a predetermined width dimension proximal the front wall of the slats and a wider portion with a larger width dimension adapted to be between the lips and rear wall of the slats; and, wherein said body has resilient first and second portions that define narrow and offset portions, said narrow portion having a width dimension adapted to be substantially equal to the width dimension of the narrow portion of the second slot and said offset portion having an offset that combines with said narrow portion to form a width dimension adapted to be larger than the width dimension of the narrow portion of the second slot, said resilient lower and upper portions permitting said offset portion to flex and fit through the narrow portion and into the wider portion of the second slot.

14. The stabilizing clip of claim 13, and wherein said resilient lower portion is spaced from said resilient upper portion, and said resilient lower portion forms a lower leg and said resilient upper portion forms an upper arm.

15. The stabilizing clip of claim 14, and wherein the slatwall assembly has a rear wall, and said lower leg and upper arm are adapted to extend toward and abut the rear wall at spaced locations.

16. The stabilizing clip of claim 15, and wherein said lower leg and upper arm have a predetermined length and said body has a front surface, said front surface of said body being adapted to be substantially flushly aligned with the front surfaces of the slats when said leg and arm abut the rear wall of the slatwall assembly.

* * * * *